US007239327B2

(12) United States Patent
Silverstein

(10) Patent No.: US 7,239,327 B2
(45) Date of Patent: Jul. 3, 2007

(54) METHOD OF PROCESSING AN IMAGE FOR DISPLAY AND SYSTEM OF SAME

(75) Inventor: Amnon Silverstein, Mountain View, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 166 days.

(21) Appl. No.: 10/040,056

(22) Filed: Dec. 31, 2001

(65) Prior Publication Data

US 2003/0122846 A1 Jul. 3, 2003

(51) Int. Cl.
*G09G 5/00* (2006.01)

(52) U.S. Cl. ..... 345/613; 345/589; 345/597; 345/598; 345/581

(58) Field of Classification Search ..... 345/613, 345/589, 597, 598, 581
See application file for complete search history.

(56) References Cited

U.S. PATENT DOCUMENTS

| | | | | |
|---|---|---|---|---|
| 5,278,949 | A * | 1/1994 | Thayer | 345/426 |
| 6,009,190 | A * | 12/1999 | Szeliski et al. | 382/154 |
| 6,317,158 | B1 * | 11/2001 | Tice | 348/447 |
| 6,384,839 | B1 * | 5/2002 | Paul | 345/613 |
| 6,396,505 | B1 * | 5/2002 | Lui et al. | 345/613 |
| 6,559,858 | B1 * | 5/2003 | Schneider et al. | 345/611 |
| 6,714,206 | B1 * | 3/2004 | Martin et al. | 345/589 |
| 6,720,972 | B2 * | 4/2004 | Feintuch | 345/589 |
| 6,816,167 | B1 * | 11/2004 | Rauchfuss et al. | 345/582 |
| 2002/0122019 | A1 * | 9/2002 | Baba et al. | 345/88 |
| 2003/0128223 | A1 * | 7/2003 | Feintuch | 345/613 |

OTHER PUBLICATIONS

The Origins of Sub-Pixel Font Rendering, http://grc.com/ctwho.htm, Nov. 30, 2000, 5 pages.
How Sub-Pixel Font Rendering Works, http://grc.com/ctw hat.htm, Nov. 30, 2000, 10 pages.

* cited by examiner

*Primary Examiner*—Matthew C. Bella
*Assistant Examiner*—Mike Rahmjoo

(57) ABSTRACT

A method for processing a digital signal to enhance the resolution is disclosed. An embodiment provides for a method of processing an image for display on a display having sub-pixel display capability. The method first maps a plurality sub-pixels of the display to corresponding regions of the image. Each sub-pixel may be mapped to a unique region of the image. Next, the method accesses the image, which was sampled to have a higher spatial resolution than the spatial resolution of the display. Then, for each sub-pixel of the display, the method calculates an intensity value for one color of a plurality of colors in the image. The calculation may be based on the intensity of that color alone. Finally, the method causes the sub-pixels on the output display to display the colors in proportion to the calculated intensities.

8 Claims, 10 Drawing Sheets

METHOD OF PROCESSING AN IMAGE FOR DISPLAY AND SYSTEM OF SAME

TECHNICAL FIELD

The present invention relates to the field of rendering images. Specifically, the present invention relates to a method for processing an image for improved visual display.

BACKGROUND ART

When displaying an image on a display screen, the resolution is limited by the number of pixels or sub-pixels on the display. In some conventional systems, the display screen comprises a number of pixels which are split into sub-pixels. For example, each pixel may have a red, a blue, and a green sub-pixel. In other systems, the sub-pixels may be magenta, cyan, and yellow. In still other systems the sub-pixels may be yellow and purple.

Some conventional systems fail to take full advantage of the resolution of the display screen because they fail to use sub-pixels individually. For example, when displaying white, the system activates a red, a blue, and a green sub-pixel. In other words, the system only makes use of a pixel. When displaying black, this system will 'turn off' the red, blue and green sub-pixels as a group. Thus, each pixel will be used to display either a white or a black region because of the blending of the light from the sub-pixels. When rendering an image which would ideally be as seen in FIG. 1A, the image is displayed with jagged lines as seen in FIG. 1B. The leftmost portion 150 is formed by three pixels stacked on top of the other. In other words, there are three red, three green, and three blue sub-pixels in area 150.

Other conventional systems improve upon the above system by ignoring the different colors of the sub-pixels and activating each sub-pixel individually. If the region to be displayed is white, this system will 'turn on' the sub-pixel regardless of its color. If the region is to be black, the system will 'turn off' the sub-pixel regardless of its color. Thus, the output is as seen in FIG. 1C for a triangle which is white and surrounded by black. In FIG. 1C, the leftmost region of the triangle starts with a single red sub-pixel, following by two green sub-pixels, followed by three blue sub-pixels, etc. This increases the spatial resolution over the rendering of FIG. 1B, however, it is best suited for displaying black and white images. When displaying color images, this conventional system may have problems, in that it is based on the intensity of the input image.

For example, displaying an image which is mostly red, the system will 'turn on' the green and the blue sub-pixels even if there is no light at those wavelengths. Thus, were the triangle in FIG. 1A to ideally be displayed all red, turning on the blue and the green sub-pixels results in a false color.

Accordingly, the present invention provides a method and system for processing a digital signal for enhancing the image quality. These and other advantages of the present invention will become apparent within discussions of the present invention herein.

DISCLOSURE OF THE INVENTION

A method for processing a digital signal to enhance the resolution is disclosed. An embodiment provides for a method of processing an image for display on a display having sub-pixel display capability. The method first maps a plurality sub-pixels of the display to corresponding regions of the image. Each sub-pixel may be mapped to a unique region of the image. Next, the method accesses the image, which was sampled to have a higher spatial resolution than the spatial resolution of the display. Then, for each sub-pixel of the display, the method calculates an intensity value for one color of a plurality of colors in the image. The calculation may be based on the intensity of that color alone. Finally, the method causes the sub-pixels on the output display to display the colors in proportion to the calculated intensities.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

In the following detailed description of the present invention, numerous specific details are set forth in order to provide a thorough understanding of the present invention. However, it will be obvious to one skilled in the art that the present invention may be practiced without these specific details or by using alternate elements or methods. In other instances well known methods, procedures, components, and circuits have not been described in detail as not to unnecessarily obscure aspects of the present invention.

Figure 1A:
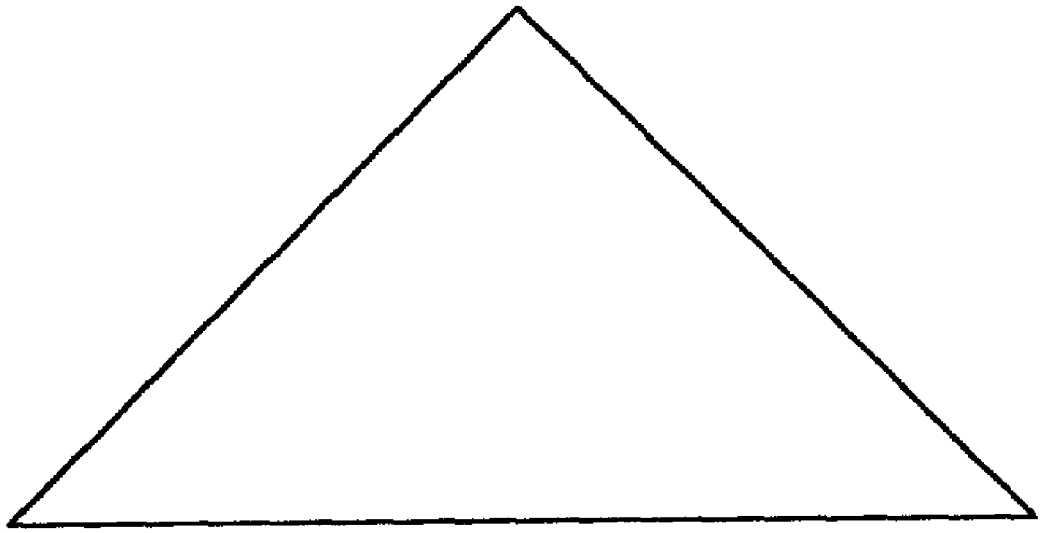
FIG. 1A is a diagram illustrating an image that is to be displayed.
Figure 1B:
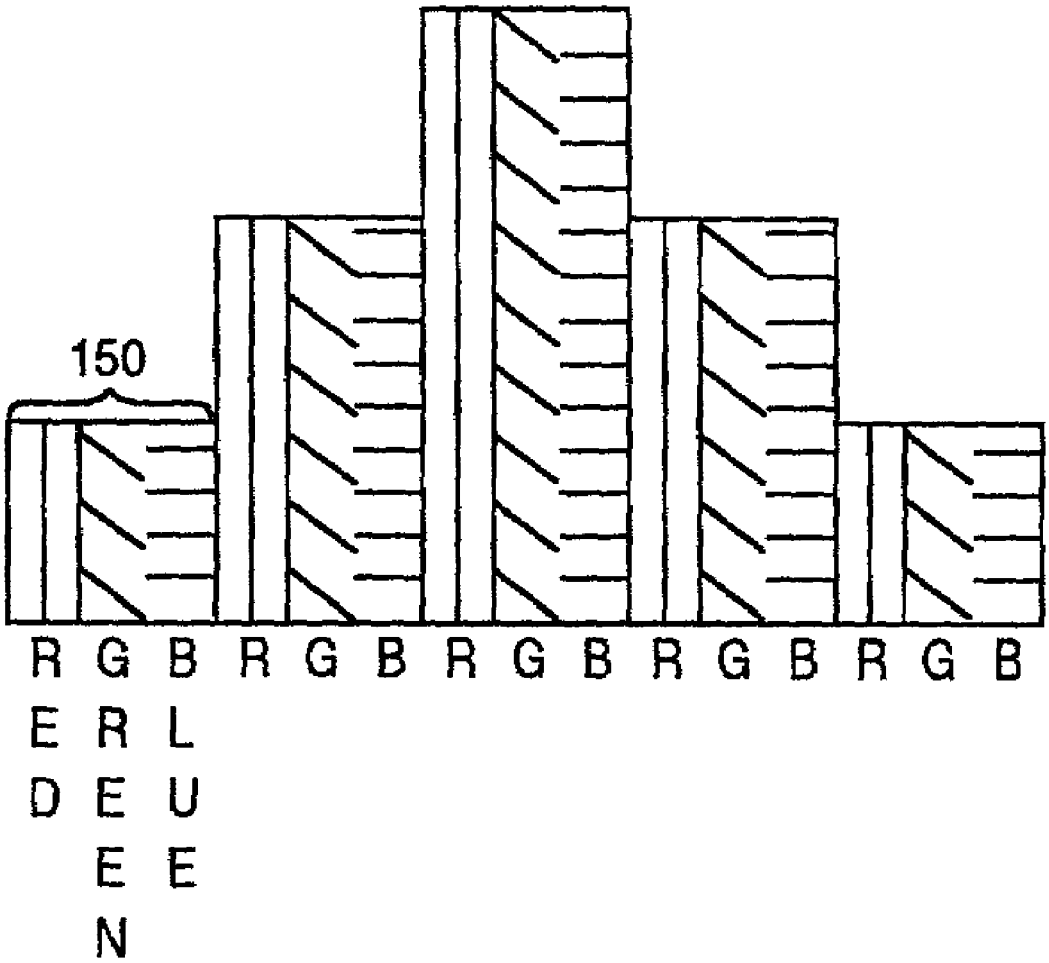
Fig. 1B (Prior Art)
FIG. 1B is a diagram illustrating a conventional method of displaying an image using pixel rendering.
Figure 1C:
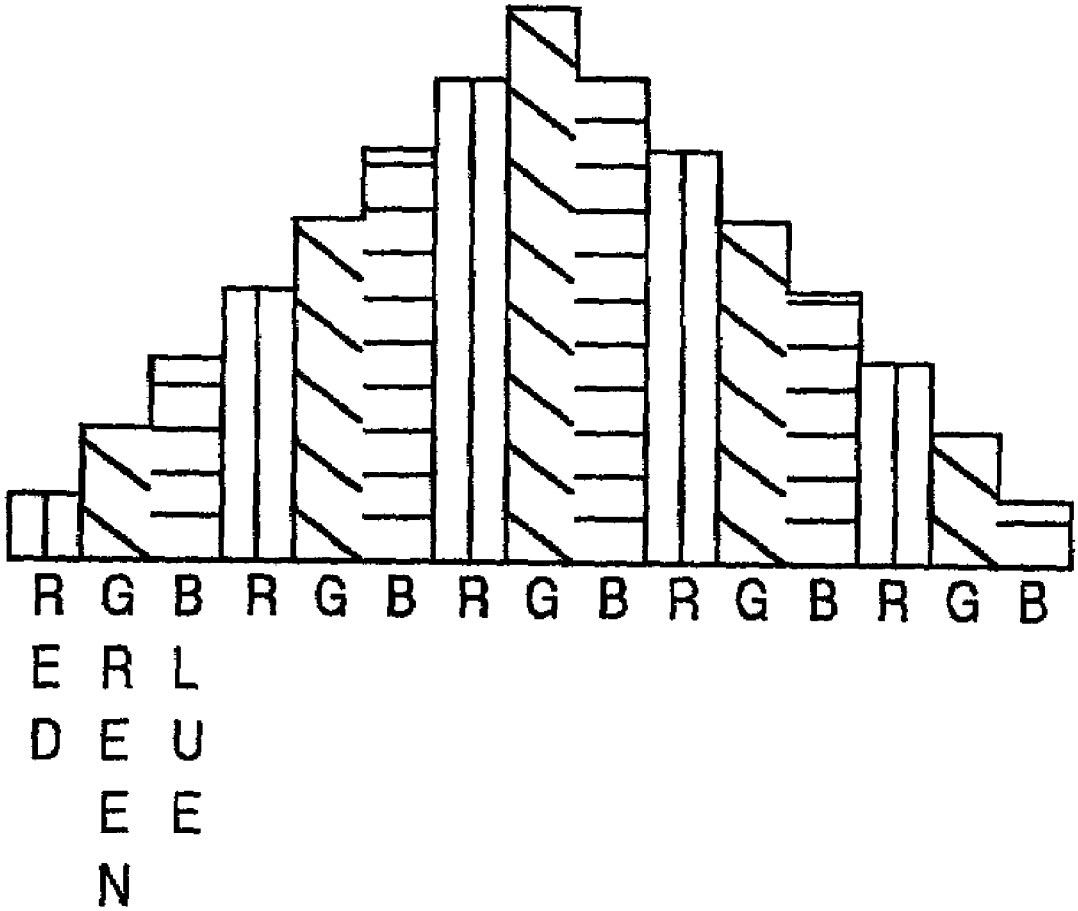
Fig. 1C (Prior Art)
FIG. 1C is a diagram illustrating a conventional method of displaying an image using sub-pixel rendering.
Figure 2:
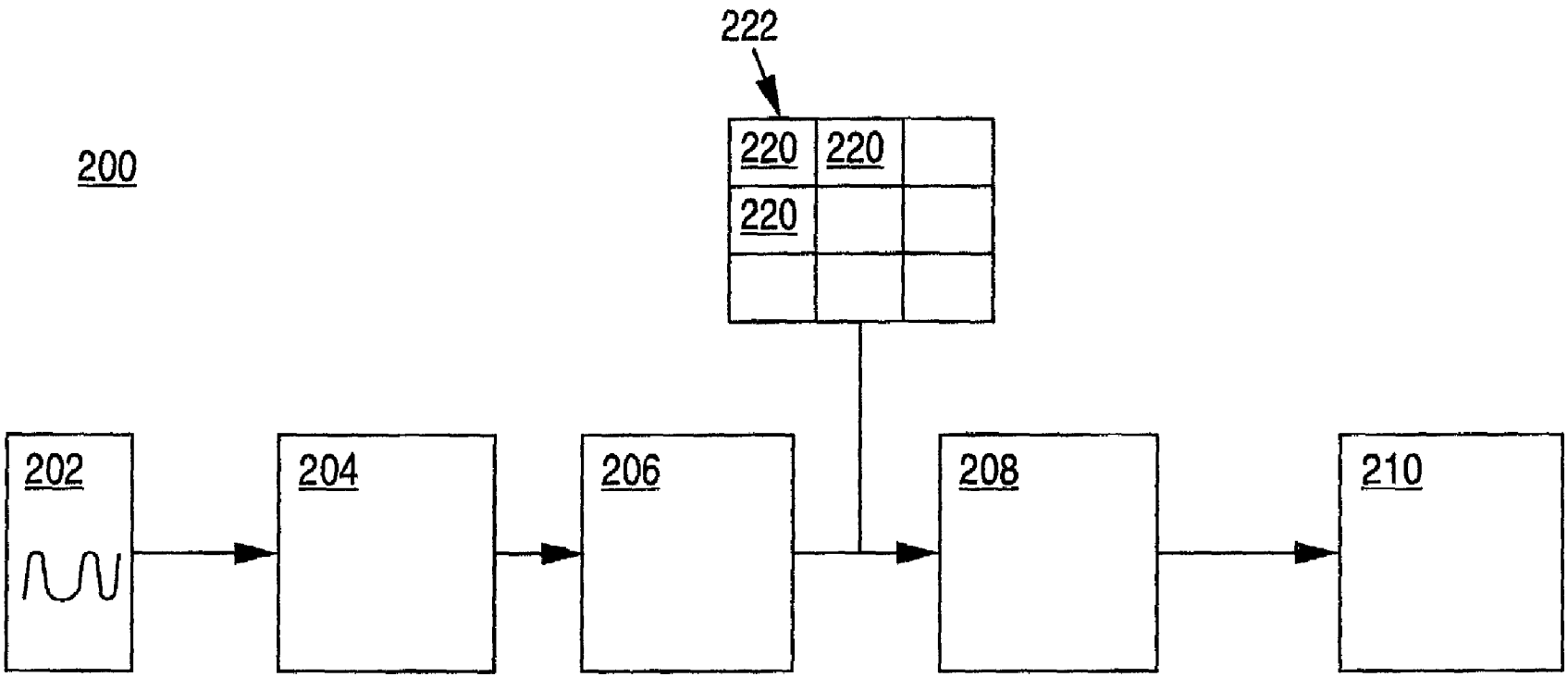
FIG. 2 is a diagram of a system for processing a digital image, in accordance with embodiments of the present invention.

The present invention provides for a method and system for pre-mosaicing for image display. FIG. 2 illustrated a system 200 in which embodiments of the present invention may be practiced. An image 202 is sampled by conventional techniques by sampling logic 204. The sampled image may comprise information for color values at each point or sub-region 220. Throughout this application the term sub-region 220 may be used to donate an area of the sampled image 222 that contains information for a plurality of colors. For example, in one embodiment, the image 222 has a red, a blue, and a green intensity value for each sub-region 220. Thus, the sampled image 222 may be suitable for display by causing the pixels and/or sub-pixels of a conventional display screen 210 to display the colors at appropriate intensities.

Embodiments of the present invention are well suited to other color schemes as well. For example, the sampled image 222 may comprise information for magenta, cyan, and yellow at each sub-region 220. As is well understood in the art, three colors may be selected such that most colors from the input image 202 may be rendered on the display 210. In fact, embodiments of the present invention are well suited to processing images 202 that were sampled for a display 210 having only two colors, for example, yellow and purple. However, the present invention is not limited to using two or three colors per sub-region 220. Nor is the present invention limited to the colors schemes described herein.

After sampling the image 202 and creating the digitized information, the sample may be filtered by filtering logic 206 (e.g., perform a color space transformation) such that a sampled image, which was suitable to be displayed via a first color coordinate system is transformed to be suitable to be displayed via a second color coordinate system. For example, the sampled image 222 may have been sampled to be displayed on a red, green, blue system. It may be filtered to be suitable to be displayed on a magenta, yellow, cyan system, as is well understood by those of ordinary skill in the art. The filtering step is optional in that the sampled image 222 may already be suitable with display 210.

Figure 7:
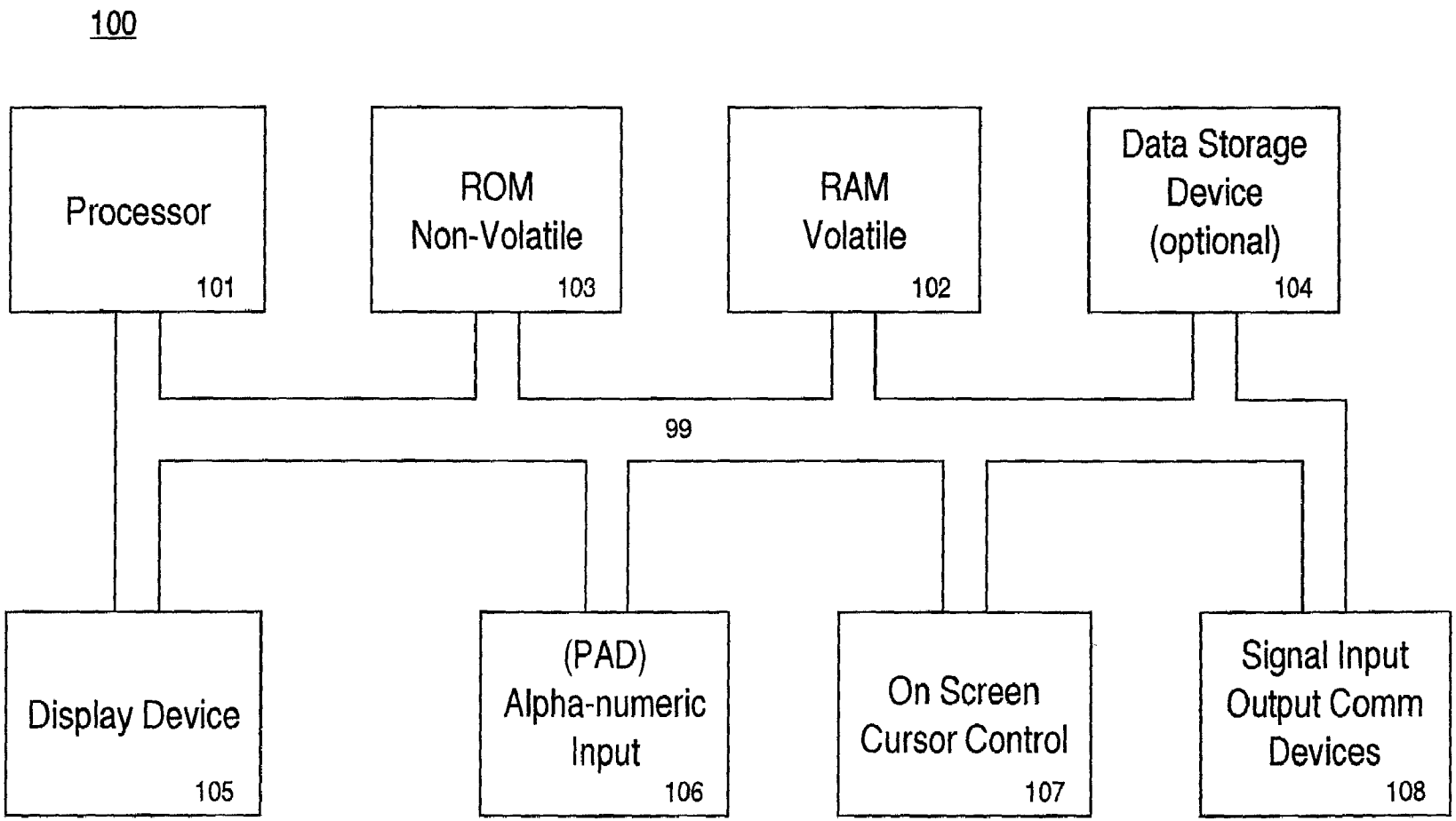
FIG. 7 is a schematic of a computer system, which may be used to implement embodiments of the present invention.

Next, the image 222 is processed by processing logic 208, which may be implemented by, for example, computer system 100 of FIG. 7. The processing provides for a technique of taking advantage of the sub-pixel controllability of many display screens 210 and also is suitable for color images.

Figure 3A:
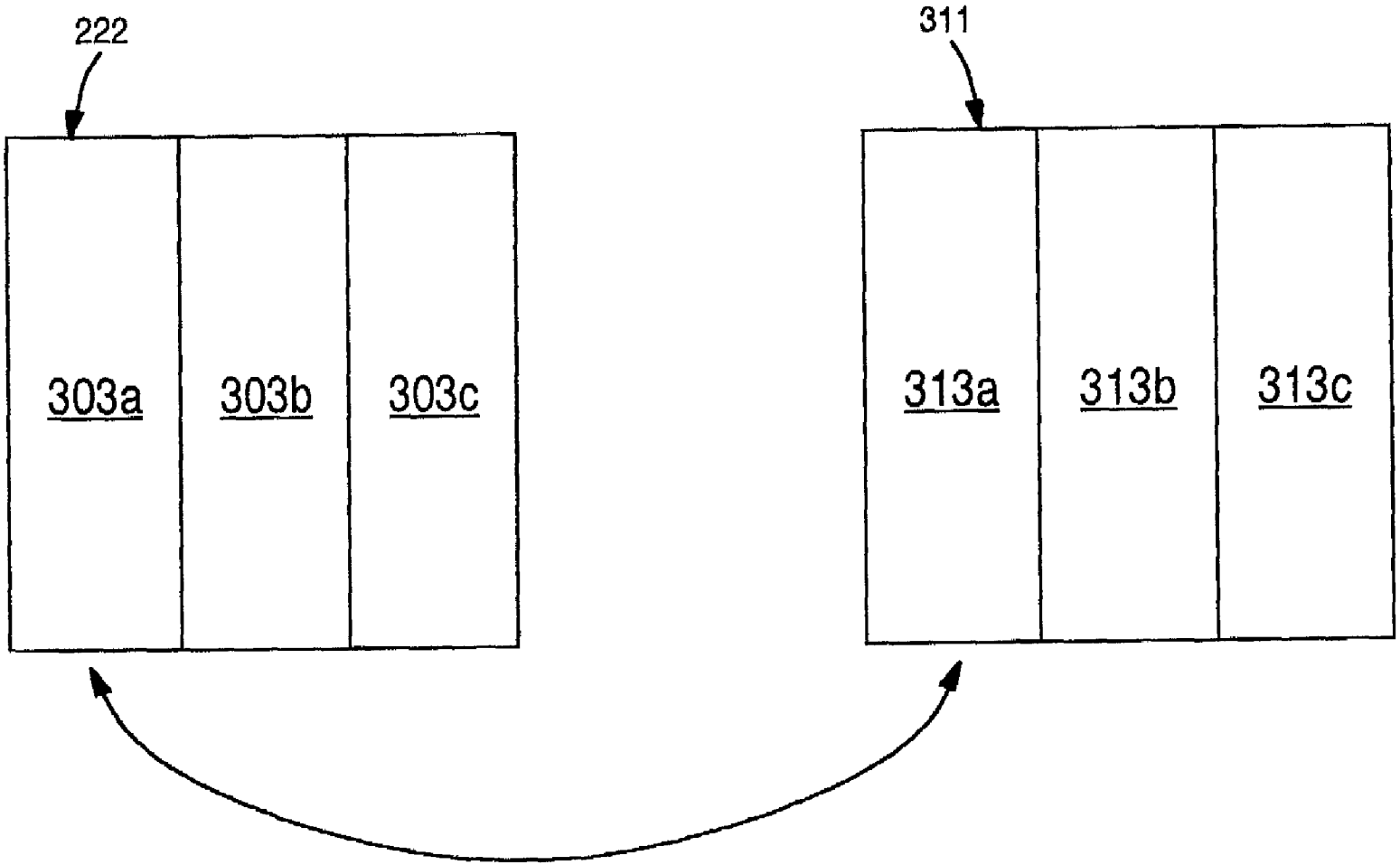
FIG. 3A and FIG. 3B are diagrams illustrating the mapping of an image to a display, in accordance with embodiments of the present invention.
Figure 3B:
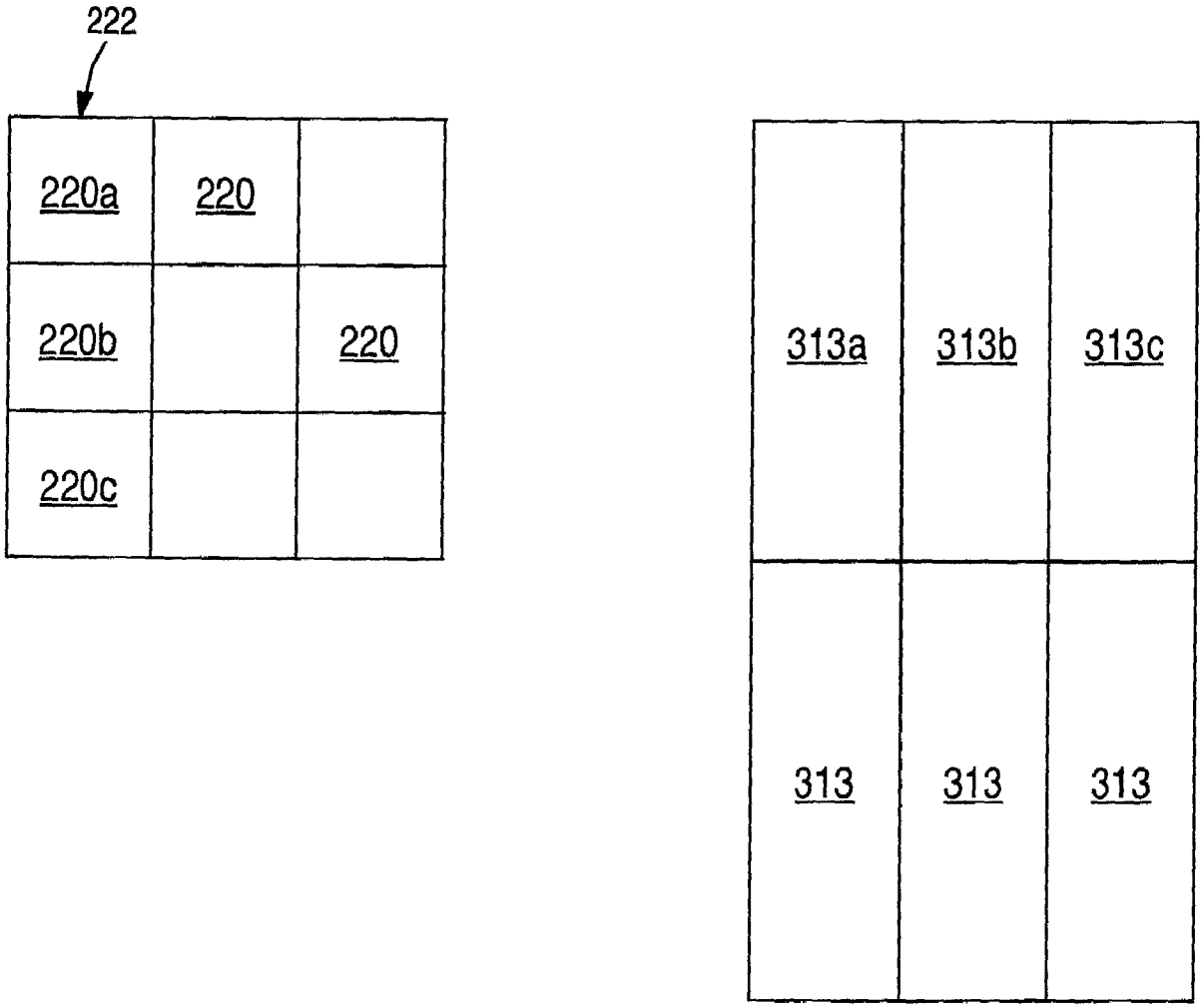

FIG. 3A and FIG. 3B show a small portion of a sampled image 222, which comprises regions 303. Each region 303 is made up of one or more sub-regions (e.g., 220*a*, 220*b*, 220*c*). Each sub-region 220 contains an intensity value for each color of the color scheme being used. For example, sub-region 220*a* contains a red, a blue, and a green intensity value. Likewise, sub-regions 220*b* and 220*c* also contain values for each color. These values are derived by sampling the input image 202, as is well understood by those of ordinary skill in the art.

Also shown in FIG. 3A is a pixel 311, which may be a small portion of display screen 210. The output display 210 may be divided into pixels 311, each with a number of areas or sub-pixels 313. For clarity FIG. 3A shows only one pixel 311 of the output display 210, while FIG. 3B shows two pixels 311. The pixel 311 may have a red 313*a*, a green 313*b*, and a blue sub-pixel 313*c*. However, the output display 210 may have other color schemes, so long sub-pixels 313 are individually controllable. By individually controllable it is meant that the sub-pixels 313 may be controlled in some fashion such that the sub-pixel 313 is caused to become 'active', without substantially affecting its neighbors.

Sub-pixels 313 in the output display 210 are mapped to regions 303 of the input display (e.g., the sampled image 222). Each sub-pixel 313 may be mapped to a unique region 303 of the sampled image 222. In this example, the red sub-pixel 313*a* is mapped to region 303*a*, the green sub-pixel 313*b* is mapped to region 313*b*, and the blue sub-pixel 313*c* is mapped to region 303*c*. It will be understood that region 303 contains information for all colors in the color scheme. A region 303, in turn, may be made up of three sub-regions 220. Thus, the image 222 has a higher resolution than the output display 210. The green 313*b* and the blue 303*c* sub-pixels are mapped to regions 303*b* and 303*c*, respectively.

Embodiments of the present invention calculate the average intensity of, for example, red over region 303*a* and assign a suitable value to the red sub-pixel 313*a* based on this value. In some embodiments, the green and the blue intensity values in region 303*a* are not used to calculate the intensity of red to be displayed in sub-pixel 313*a*.

Thus, in one embodiment, the intensity of red in region 303*a* is used to determine what the intensity of red should be for sub-pixel 313*a*. The intensity of green in region 303*b* is used to determine what the intensity of green should be for sub-pixel 313*b*. And the intensity of blue in region 303*c* is used to determine what the intensity of blue should be for sub-pixel 313*c*. However, in other embodiments, a sampling kernel is used to form a weighted average of the neighborhood of the region 303 of the original image 222. Thus, for example, the intensity of red to be displayed in sub-pixel 313*a* is not a function of only the intensity of red in the region 303*a* of the original image 222.

For example, the intensity of green to be displayed in sub-pixel 313*b* is determined by the weighted average of the green intensity of regions 303*a*, 303*b*, and 303*c* of the input image 222. In a similar fashion, the intensity of red to be displayed in sub-pixel 313*a* is determined by the weighted average of the red intensity of a region to the left of 303*a* (not shown), region 303*a*, and region 303*b* of the input image 222. In a similar fashion, the intensity of blue to be displayed in sub-pixel 313*c* is determined by the weighted average of the blue intensity of region 303*b*, region 303*c*, and a region to the right of 303*c* (not shown). Thus, each sub-pixel 313 has its own unique plurality of regions 303 for which its intensity is calculated.

The resulting colors to be displayed may have some errors. An embodiment diffuses these errors to other sub-pixels 313, which may have the same color as the sub-pixel 313 for which the error arose. For example, consider six regions 303 that have red, green, and blue values, as shown by the following notation, [Red, Green, Blue]:

[10, 10, 10][10, 9, 9][8, 5, 5][10, 11, 10][10, 10, 10][10, 10, 10]

The desired output for the sub-pixels 313 has a color value for one color and is zero for the other two colors, as the output display is only capable of displaying one color per sub-pixel 313. Thus, it is desired to calculate a single color intensity for each of the six sub-pixels shown below (e.g., red intensity for the first sub-pixel, a green for the second sub-pixels, etc.). In other words, one red intensity may be calculated for every three regions 303 of the input image 222. Likewise for green and blue. Thus, it is desired to determine color values for the question marks using the notation above in order to determine the intensity for six sub-pixels 313.

[?, 0, 0][0, ?, 0][0, 0, ?][?, 0, 0][0, ?, 0][0, 0, ?]

The first sub-pixel 313 on the output display 210 may be computed as the average of the first three red input image 222 values. For example, using the image values above, the average of the first three regions 303 is 9.33. The nearest fitting red value is 9. Thus, an error of 0.33 results. This error can be propagated to one or more regions of the input image. For example, the input image 222 may be altered to factor in the error just calculated as follows.

[10, 10, 10][10, 9, 9][8, 5, 5][10, 11, 10][10.33, 10, 10][10, 10, 10]

When calculating the value for the next red sub-pixel 313, the last three regions 303 above are used (e.g., 10; 10.33;

10). Thus, the error is factored into future calculations. The error may be propagated on in other ways, as well. For example, the error may be multiplied by 3 to for the error to be an integer. Furthermore, while in the present embodiment the error was propagated to the middle three of the three regions 303 to be used in the next calculation (e.g., the fifth region above), the error may be propagated to one or more of the other regions if desired. For example, the error could be propagated on to the fourth and/or sixth region.

Embodiments of the present invention are well-suited for displays with various pixel patterns. For example, referring to FIG. 3B, the sub-pixels below the red, green, and blue sub-pixels may repeat the same pattern (e.g., red below red, etc.). However, the lower row may have a green sub-pixel 313 below the red sub-pixel 313*a*, for example. Furthermore, the sub-pixels 313 may be a various shapes. The error processing may depend upon the shape of the sub-pixels 313 and their layout. Furthermore, each sub-pixel 313 may have its own error processing routine.

In another embodiment, the fact that the green and the blue values in region 303 and not factored into the display of sub-pixel 313*a* is remembered as an error. When, for example, the values for the green sub-pixel 313*b* is determined, the error which occurred in processing two other regions 303 is carried over and used to compensate.

Figure 4:
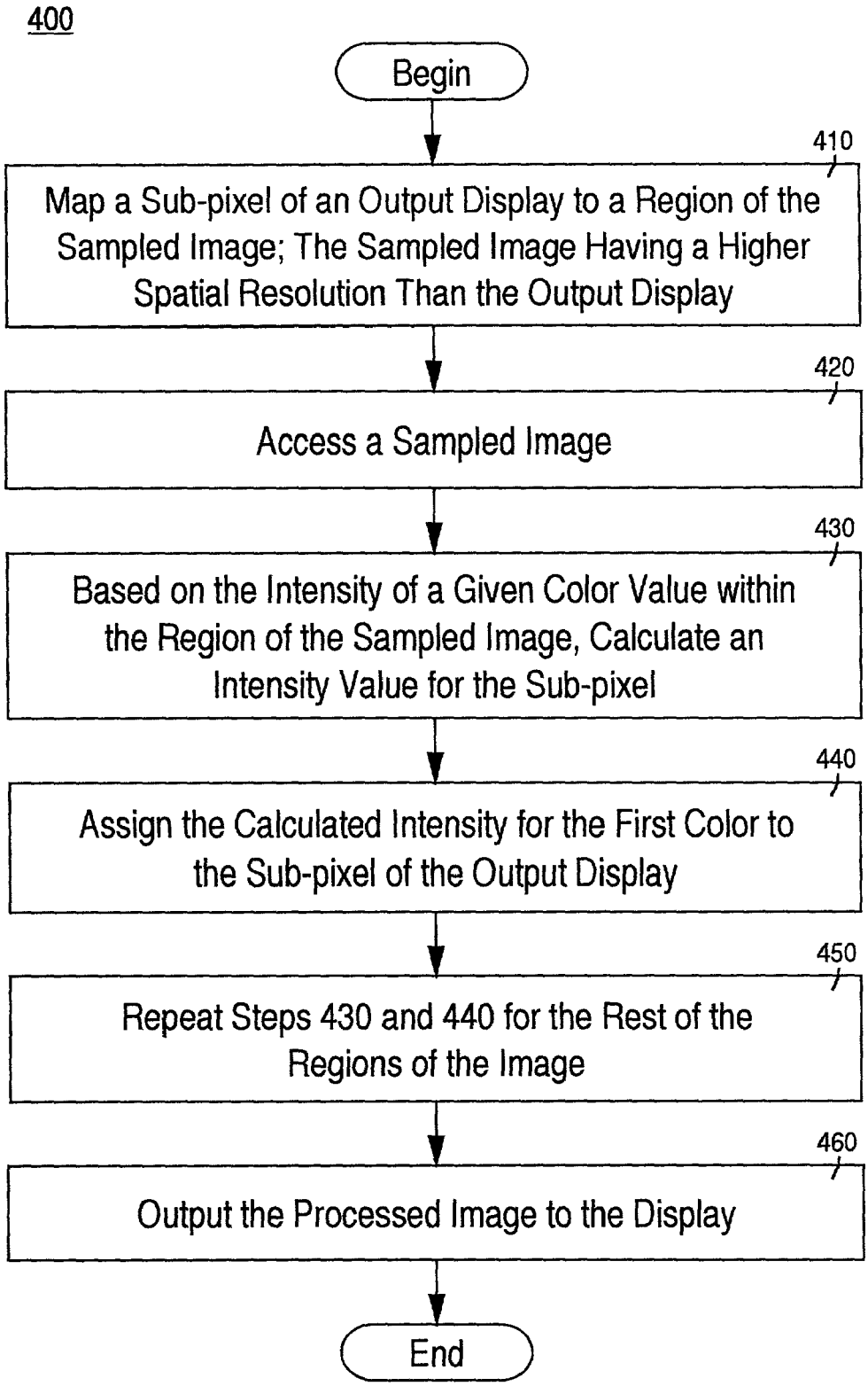
FIG. 4 is a flowchart illustrating the steps of a process of processing a digital image, in accordance with embodiments of the present invention.

FIG. 4 shows a process 400 for processing a digitized image 222. Process 400 may be implemented within system 200, using computer system 100 to process the image.

In step 410, sub-pixels 313 of the output display 210 are mapped to a region 220 of the sampled image 222. This mapping may be such that that each region 303 of the image 222 corresponds to only one sub-pixel 313 of the output and vice versa. However, the present invention is not limited to this mapping technique. Embodiments may map a single sub-pixel 313 of the output display 210 to more than one region 303 of the sampled image 222. The input image 222 may have a higher spatial resolution than the output 210, as seen in FIG. 3B.

In step 420, the process 400 accesses a sampled image 222, for example, image 222 after it has been processed by sampling logic 204 and, optionally, filter 206.

Figure 5:
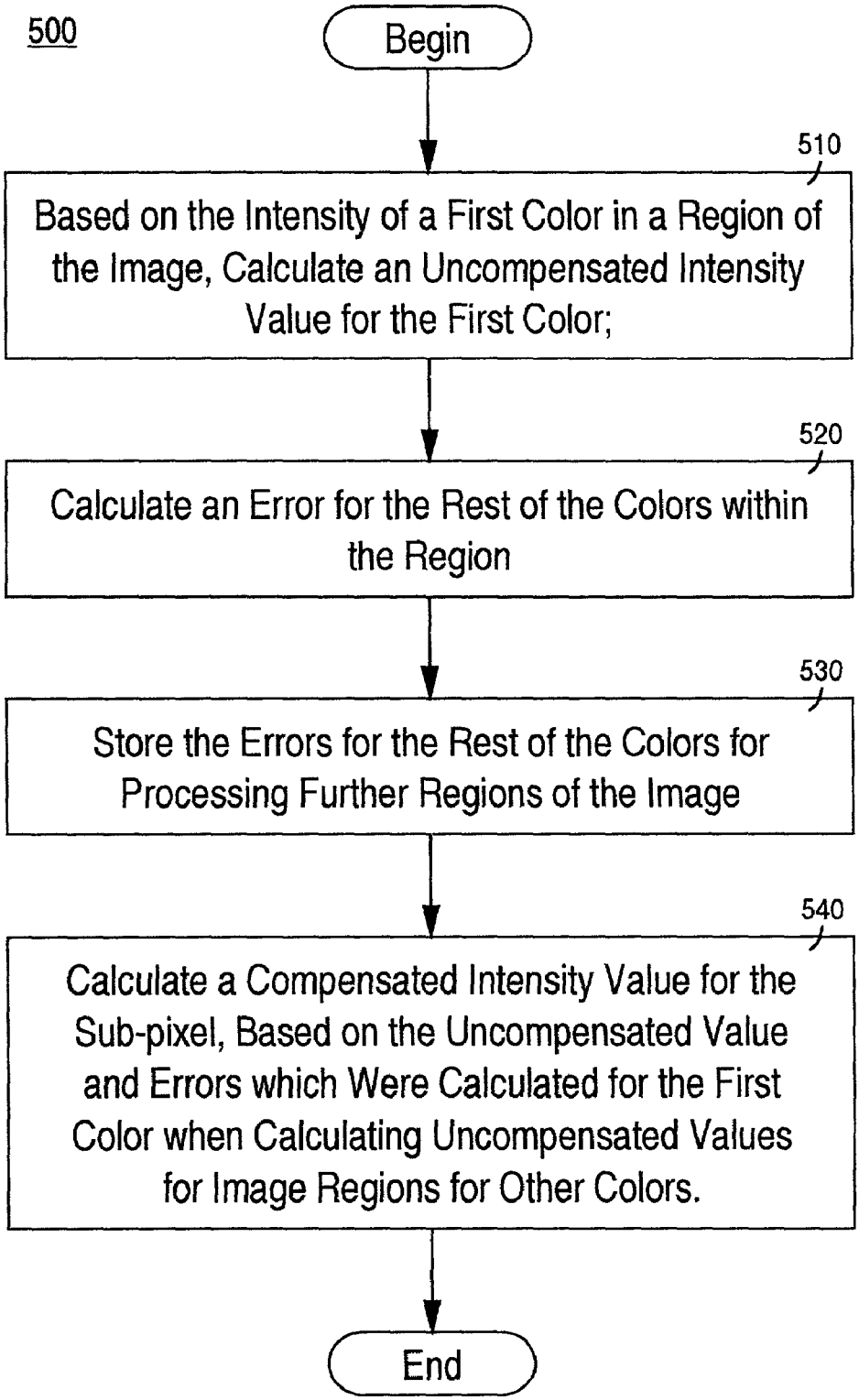
FIG. 5 is a flowchart illustrating the steps of a process of finding a best fit between a region of a digital image and a sub-pixel of a display, in accordance with embodiments of the present invention.
Figure 6:
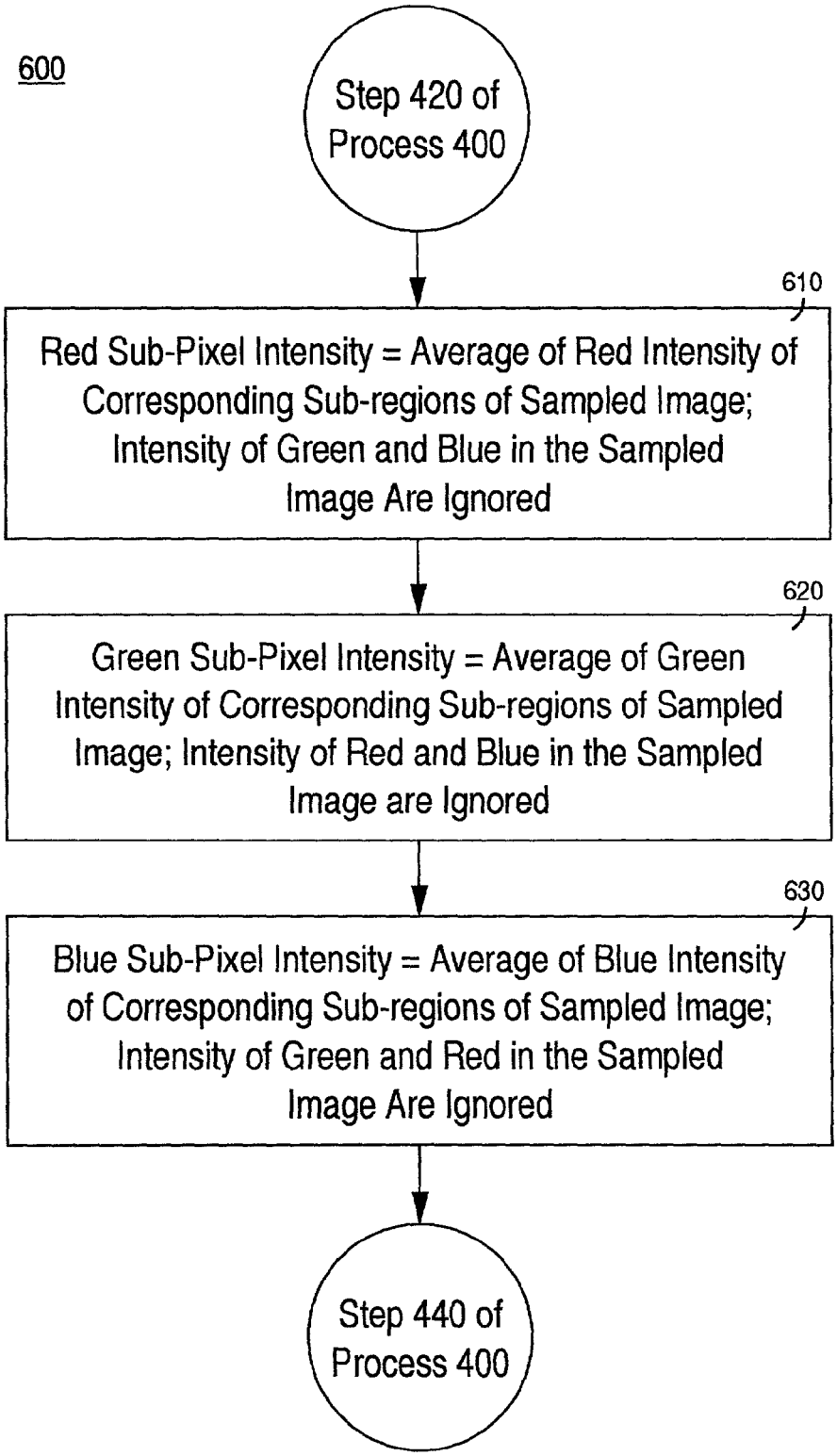
FIG. 6 is a flowchart illustrating the steps of a process of processing a digital image, in accordance with embodiments of the present invention.

In step 430, the process 400 calculates an intensity value for the sub-pixel 313, based on the intensity of a color within the corresponding region 303 of the sampled image 222. Embodiments provide for various methods of performing this calculation. FIG. 5 illustrates one such method. FIG. 6 illustrates another method.

In step 440, the process 400 assigns the calculated value to the sub-pixel 313 of the output display. For example, the calculated intensity of red for region 303*a* is assigned to sub-pixel 313*a*.

Then, in step 450, step 430 through step 440 are repeated for the rest of the regions 303 of the image 222, and therefore, the rest of the sub-pixels 313 of the output display 210.

Finally, in step 460, the processed image is output to the display 210. It will be understood that the process 400 is well suited to perform steps in another order and steps such as outputting to the display 210 may in fact be performed while other regions 303 are being processed.

FIG. 5 illustrates a process 500, which performs the calculation of the intensity with which to display at a sub-pixel 313 of the output display 210. This process 500 may be used at step 430 of process 400. Furthermore, process 500 may be implemented in a general purpose computer such as computer system 100.

Referring again to FIG. 3A, the compensated green value, for example, may be based on the intensity of green in region 303*b* (e.g., uncompensated value), with the value of green in regions 303*a* and 303*c* (e.g., error values) used to modify the uncompensated value. It will be understood that the errors may be taken from other regions 303.

Referring now to FIG. 5, in step 510 process 500 first finds an uncompensated intensity value for a first color in a region (e.g., region 303*a*) of the image 222 for a sub-pixel 313*a* of the output display 210. The display sub-pixel 313*a* provides for only a single color; however, the corresponding region 303*a* of the image 222 has information for a number of colors. For example, in one color scheme, the output sub-pixel 313*a* is red, while the image 222 has red, green and blue information. Only red information is used to calculate the uncompensated value.

In step 520, an error is calculated for the region 303*a* being processed for each color that is not provided for in the corresponding output sub-pixel 313*a*. For example, a green error and a blue error are calculated. The green error is based upon the intensity of the green in the region 303*a* being processed. In a similar fashion a blue error is calculated.

In step 530, these errors are stored for processing further regions 303 of the image. For example, the green error for region 303*a* will be used when processing the region 303*b* of the image which corresponds to a green sub-pixel in the output. There will be an additional green error from the processing of a region (e.g., region 303*c*) of the image 222 that corresponds to a blue output sub-pixel 313*c*, as well.

Then in step 540, the process 500 calculates a compensated intensity value for the red sub-pixel 313*a*. This is based on the uncompensated value of the red intensity for this region 303*a*, which was calculated in step 510, along with two red error values. The red error values may be from the processing of regions 303 with corresponding green and a blue output sub-pixels 313. The present invention is not limited to using regions 303 which were already processed for error values. For example, the errors may come from regions 303 which are yet to be processed for an uncompensated fit value, with the error being 'passed back'.

One embodiment of the present invention averages the intensity values in sub-regions 220 of the sampled image 222 to produce intensity values for the output sub-pixels 313. The following may be used in step 430 of process 400. In this example, a red, green, blue color coordinate system is used. However, embodiments of the present invention are well suited to other color coordinate systems.

Referring to FIG. 3A, FIG. 3B, and process 600 of FIG. 6, the sampled image has intensity values for red, blue, and green for each sub-region 220. In one embodiment sub-pixel 313*a* is mapped to region 303*a*. Therefore, the red intensity values for sub-regions 220*a*, 220*b*, and 220*c* are averaged to produce an intensity value for the red sub-pixel 313*a*.

Then, in step 620 the green intensity is calculated in an analogous fashion. The green sub-pixel 313*b* is based on the averages of the sub-regions 220 in region 303*b* of the sampled image 222.

In step 630, the blue intensity is calculated in an analogous fashion. Next, the steps of process 400 may be executed to continue the processing, starting at step 440 of FIG. 4.

FIG. 7 illustrates circuitry of computer system 100, which may form a platform for embodiments of the present invention. Computer system 100 includes an address/data bus 99 for communicating information, a central processor 101 coupled with the bus 99 for processing information and instructions, a volatile memory 102 (e.g., random access memory RAM) coupled with the bus 99 for storing information and instructions for the central processor 101 and a non-volatile memory 103 (e.g., read only memory ROM) coupled with the bus 99 for storing static information and instructions for the processor 101. Computer system 100 also includes an optional data storage device 104 (e.g., a magnetic or optical disk and disk drive) coupled with the bus 99 for storing information and instructions.

With reference still to FIG. 7, system 100 of embodiments of the present invention also includes an optional alphanumeric input device 106 including alphanumeric and function keys is coupled to bus 99 for communicating information and command selections to central processor unit 101. System 100 also optionally includes a cursor control device 107 coupled to bus 99 for communicating user input information and command selections to central processor unit 101. System 100 of the present embodiment also includes an optional display device 105 coupled to bus 99 for displaying information. The system 100 may also couple to display 210 for displaying the processed image. A signal input/output communication device 108 coupled to bus 99 provides communication with external devices.

The preferred embodiment of the present invention, a method and system for pre-mosaicing an image, is thus described. While the present invention has been described in particular embodiments, it should be appreciated that the present invention should not be construed as limited by such embodiments, but rather construed according to the below claims.

What is claimed is:

1. A method of processing an image for display on a display having sub-pixel display capability, said method comprising:

mapping a plurality of sub-pixels of said display to corresponding spatial regions of said image, wherein each sub-pixel of said display is mapped to a unique spatial region of said image;

accessing said image, said image sampled at a higher spatial resolution than the spatial resolution of said display;

for each sub-pixel, calculating an intensity value for said sub-pixel using only intensity information for a first color from said corresponding spatial region; and rendering said image on said display, based on said calculated intensities.

2. A method as described in claim 1 wherein the calculating comprises:

averaging the intensity value of said first color over a plurality of spatial regions neighboring said spatial region of said image, wherein each of said sub-pixels maps to its own plurality of spatial regions.

3. A method as described in claim 1, wherein the calculating comprises:

based on the intensity of said first color in said spatial region of said image, calculating an uncompensated intensity value for said first color;

calculating an error for each of the rest of said plurality of colors within said spatial region, storing said errors for said rest of said colors for processing further regions of said image; and calculating a compensated intensity value for said spatial region, based on said uncompensated intensity value and errors which were calculated for said first color when processing other image regions.

4. A method as described in claim 3, wherein the compensated intensity value calculating comprises calculating said errors for said spatial region when processing a spatial region for which uncompensated values are calculated for other colors of said plurality.

5. A method as described in claim 1, further comprising:

filtering said image prior to calculating the intensity value for said sub-pixel, thereby producing a filtered image having a similar color scheme as said display.

6. A method as described in claim 1, wherein the calculating comprises:

for each sub-pixel of said display, mapping said sub-pixel to a spatial region of said image, wherein each sub-pixel corresponds to a single color and said spatial region of said image comprises intensity information for said plurality of colors.

7. A method as described in claim 1, wherein the calculating comprises:

based on the intensity of said first color in said plurality of spatial regions of said image, calculating an intensity value for said first color;

calculating an error for said first color; and propagating said error for said first color for processing further spatial regions of said image.

8. A method as described in claim 7, wherein the calculating further comprises using in the intensity value calculating an error that was propagated when processing another area for said first color.

* * * * *